US006528939B1

(12) United States Patent
Kawase

(10) Patent No.: US 6,528,939 B1
(45) Date of Patent: Mar. 4, 2003

(54) IMAGE-FORMING APPARATUS AND METHOD OF MANUFACTURE THEREFOR

(75) Inventor: Toshimitsu Kawase, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/511,240

(22) Filed: Feb. 23, 2000

(30) Foreign Application Priority Data

Feb. 24, 1999 (JP) ..... 11-047090

(51) Int. Cl.[7] ..... H01J 1/62

(52) U.S. Cl. ..... 313/495; 313/512; 313/634; 313/445; 313/583

(58) Field of Search ..... 313/512, 495, 313/634, 445, 25, 43, 44, 583, 607

(56) References Cited

U.S. PATENT DOCUMENTS 4,033,664 A * 7/1977 Norman ..... 439/388
5,770,918 A * 6/1998 Kawate et al. ..... 252/514
6,114,804 A * 9/2000 Kawase et al. ..... 313/495

FOREIGN PATENT DOCUMENTS

| | | |
|---|---|---|
| EP | 0 660 357 | 6/1995 |
| JP | 4-163833 | 6/1992 |
| JP | 5-114372 | 5/1993 |
| JP | 7-235255 | 9/1995 |

* cited by examiner

*Primary Examiner*—Sandra O'Shea
*Assistant Examiner*—Guiyoung Lee
(74) *Attorney, Agent, or Firm*—Fitzpatrick, Cella, Harper & Scinto

(57) ABSTRACT

An image-forming apparatus includes a vacuum container having a first plate and a second plate arranged opposite to the first plate, an electron source disposed on the first plate and provided within the vacuum container, and an image-forming member disposed on the second plate within the vacuum container and irradiated with an electron emitted from the electron source. An airtight lead-in terminal has a first end in electrical contact with the image-forming member and a second end leading outside of the vacuum container through a hole in the first plate. The second end leading outside of the vacuum container is held and fixed so as not to protrude from an outer surface of the first plate.

5 Claims, 6 Drawing Sheets

IMAGE-FORMING APPARATUS AND METHOD OF MANUFACTURE THEREFOR

BACKGROUND OF THE INVENTION

1. Field of the Invention

The present invention relates to an image-forming apparatus and a method of manufacture therefor More particularly, the invention relates to the structure of the anode terminal unit of a flat panel electron image-forming apparatus.

2. Related Background Art

Conventionally, the CRT has been used widely as the image-forming apparatus that displays images by the utilization of electron beams. Meanwhile, the use of the flat panel display, which adopts liquid crystal in place of the CRT, has been promoted in recent years. However, since the flat panel display is not self-emissive, a problem is encountered that a display of the kind should be provided with a back light or the like. Therefore, it has been long sought to develop a display of the kind, but one which is of the self-emissive type.

In recent years, merchandizing of a plasma display as a self-emissive display has begun. The principle of the emission thereof is different from that of the conventional CRT. The plasma display is still inferior to the CRT with respect to the image contrast and coloring, among some other aspects. With anticipation that a flat panel image-forming apparatus should provide emission as good in quality as the CRT if a plurality of electron emission devices are arranged, various researches and developments have been carried out. For example, in the specification of Japanese Patent Application Laid-Open No. 4-163833, there has been disclosed a flat panel electron emission image-forming apparatus which contains a linearly thermionic cathode and a complicated electrode structure in a vacuum container.

In general, it has been known that a method for forming a vacuum container of the kind comprises a step of sealing the glass rear plate having an electron source formed for it, and the glass face plate having an image-forming member formed for it airtightly through a frame by use of a sealing material or comprises a step of sealing both the rear and face plates airtightly only by use of a sealing material if the panel interval is narrower between them.

Here, as the sealing material, low-fusion point glass, and a process is applied so that the temperature is raised to 400° C. in order to soften this material. In this process, then, the face and rear plates, the atmosphere supporting spacer which is needed for the formation of the vacuum panel, the anode terminal which will be described later, and various other structural members are also exposed to such high temperature. The interior of the sealing panel thus produced through these processes is evacuated in the evacuation process for the vacuum container. Then, the external driving circuit, and the leading out wiring formed on the rear plate side are electrically connected. After this process, the panel is incorporated in the housing to complete the image-forming apparatus.

With the image-forming apparatus thus formed that uses electron beams, electrons are emitted to the desired positions by the provision of image signals from the external signal processing circuit to the rear plate leading out wiring in a state where a voltage of several to several tens of kV approximately is applied in order to accelerate electrons between two sheets of glass (the rear plate having the electron source formed for it, and the face plate having the image-forming member formed for it). Subsequently, by means of the potential difference between the two sheets of glass, electrons are accelerated to enable the image forming member of the face plate to emit light, which is obtained as images.

An image-forming apparatus of the kind is formed to be provided with the anode terminal that supplies a high voltage to the image-forming member. For example, the structure of the anode terminal, which is disclosed in the specification of Japanese Patent Application Laid-Open No. 5-114372, is arranged so that the high voltage from the high voltage generating source of the image-forming apparatus is supplied from the rear plate side to the image-forming member of the face plate through the high voltage cable, the lead-in terminal airtightly sealed on the, rear plate side of the vacuum container, the elastic member that connects the lead-in terminal and the image-forming member, among some others.

However, the aforesaid anode structure is arranged to connect the airtight lead-in terminal from the back side of the rear plate. As a result, when assembling the vacuum container, the sealing mechanism that makes the sealing from the back side of the rear plate should be installed on the back side of the manufacturing apparatus, hence making the costs of the manufacturing apparatus higher inevitably.

SUMMARY OF THE INVENTION

With a view to solving the problems discussed above, the present invention is designed. It is an object of the invention to provide an image-forming apparatus having a new anode terminal structure whereby to implement the reduction of the manufacturing costs, and also, to provide a manufacturing method thereof.

In order to achieve this object, the image-forming apparatus of the present invention forms images by the irradiation of electrons from the electron supply source formed on one plate to the image-forming member formed on the other plate in the vacuum container structured between a pair of facing plates. For this image-forming apparatus, an airtight lead-in terminal is arranged to be connected with the image-forming member on the other plate through a terminal lead-in hole arranged for one plate, and the airtight lead-in terminal is held and fixed so as not to be protruded from the outer surface of one plate.

Also, the method of the present invention for manufacturing an image-forming apparatus, which forms images by the irradiation of electrons from the electron supply source formed on one plate to the image-forming member formed on the other plate in the vacuum container structure between a pair of facing plates, comprises the step of adjusting a gap between a pair of plates to each other by use of a connecting member arranged for the abutting portion between an airtight lead-in terminal and an image-forming member when the airtight lead-in terminal is fixed to a terminal lead-in hole arranged for one plate by adhesive sealing means through a terminal supporting member.

Also, the method of the present invention for manufacturing an image-forming apparatus, which forms images by the irradiation of electrons from the electron supply source formed on one plate to the image-forming member formed on the other plate in the vacuum container structured between a pair of facing plates, comprises the step of adjusting a gap between a pair of plates to each other by use of adhesive sealing means when an airtight lead-in terminal is fixed to the image-forming member by means of a connecting member, and the airtight lead-in terminal is fixed by the adhesive sealing means to a terminal lead-in hole through a terminal supporting member.

DETAILED DESCRIPTION OF THE PREFERRED EMBODIMENTS

Figure 1:
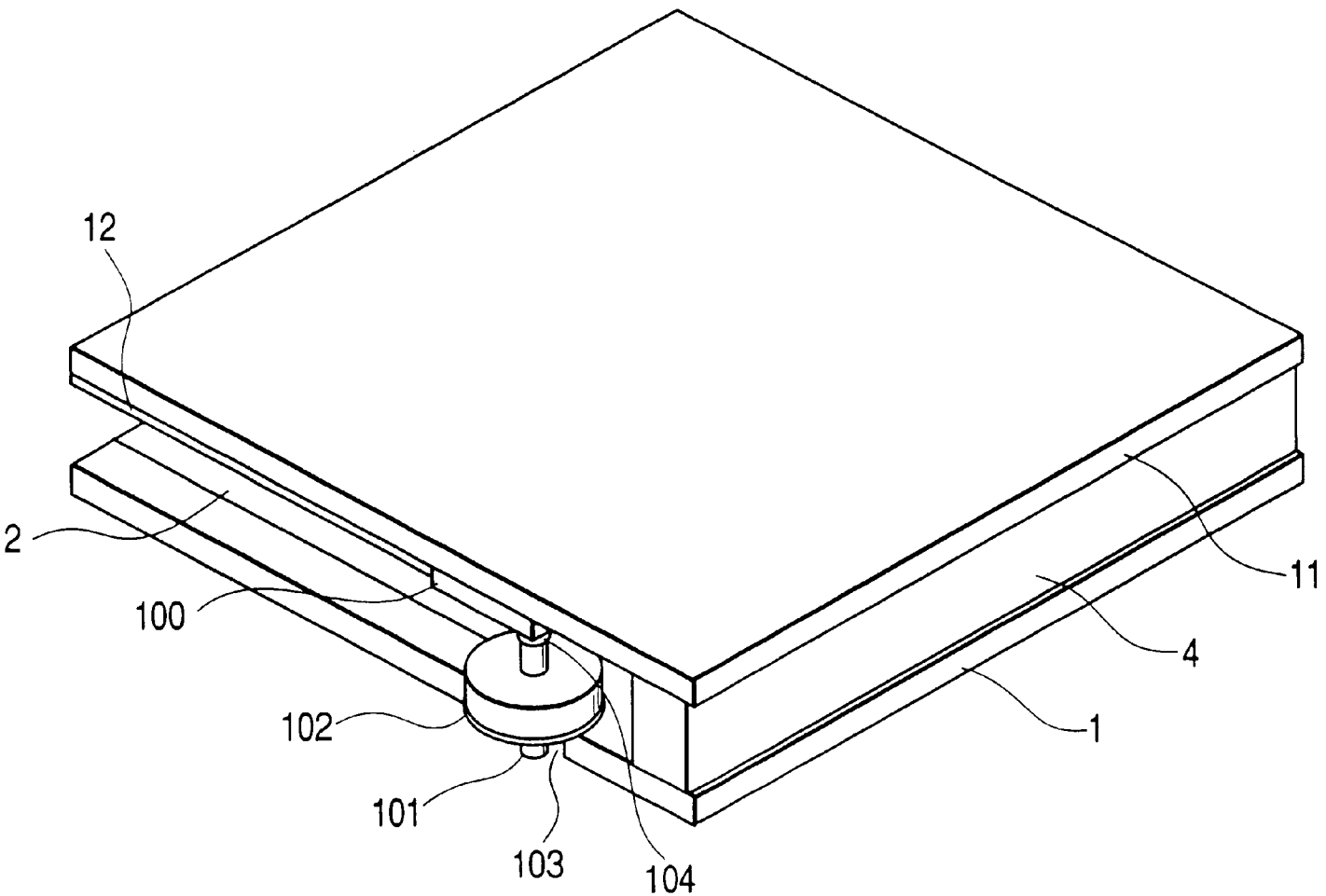
FIG. 1 is a partially broken perspective view which shows around the high voltage connecting structure of an image-forming apparatus in accordance with a first embodiment of the present invention.

In accordance with the present invention, an image-forming apparatus forms images by the irradiation of electrons from the electron supply source formed on one plate to the image-forming member formed on one plate to the image-forming member formed on the other plate in the vacuum container structured between a pair of facing plates. For this image-forming apparatus, an airtight lead-in terminal is arranged to be connected with the image-forming member on the other plate through a terminal lead-in hole arranged for one plate, and the airtight lead-in terminal is held and fixed so as not to be protruded from the outer surface of one plate.

Also, for the image-forming apparatus of the invention, a terminal supporting member is provided for holding and fixing the airtight lead-in terminal on one plate, and the terminal supporting member is fixed by adhesive sealing means so as not to be protruded at least from the outer surface of one plate.

Also, for the image-forming apparatus of the invention, the supporting member is fixed by adhesive sealing means to the inner face of one plate on the circumferential portion of the terminal lead-in hole.

Also, for the image-forming apparatus of the invention, the terminal supporting member Is fixed by adhesive sealing means to the inner face of one plate on the circumferential portion of the terminal lead-in hole and the inner circumferential face of the terminal lead-in hole.

Also, for the image-forming apparatus of the invention, the terminal supporting member is fixed by adhesive sealing means to the inner circumferential face of the terminal lead-in hole.

Also, for the image-forming apparatus of the invention, the terminal lead-in hole is tapered to be wider on the outer side of one plate.

Also, for the image-forming apparatus of the invention, the leading end of the airtight lead-in terminal and the image-forming member are connected through a conductive connecting member.

Also, for the image-forming apparatus of the invention, the connecting member Is formed by use of metallic paste material.

Also, for the image-forming apparatus of the invention, a flat abutting portion is provided for the leading end of the airtight lead-in terminal facing the image-forming member.

Also; for the image-forming apparatus of the invention, the connecting member is resilient mechanical means attachably arranged for the leading end of the airtight lead-in terminal to be resiliently in contact with the image-forming member.

Also, for the method of the invention for manufacturing an image-forming apparatus, which forms images by the irradiation of electrons from the electron supply source formed on one plate to the image-forming member formed on the other plate in the vacuum container structure between a pair of facing plates, comprises the step of adjusting a gap between a pair of plates to each other by use of a connecting member arranged for the abutting portion between an airtight lead-in terminal and an image-forming member when the airtight lead-in terminal is fixed to a terminal lead-in hole arranged for one plate by adhesive sealing means through a terminal supporting member.

Also, for the method of the invention for manufacturing an image-forming apparatus, which forms images by the irradiation of electrons from the electron supply source formed on one plate to the image-forming member formed on the other plate in the vacuum container structured between a pair of facing plates, comprises the step of adjusting a gap between a pair of plates to each other by use of adhesive sealing means when an airtight lead-in terminal is fixed to the image-forming member by means of a connecting member, and the airtight lead-in terminal is fixed by the adhesive sealing means to a terminal lead-in hole through a terminal supporting member.

The Embodiments of the Present Invention

Hereinafter, with reference to the accompanying drawings, the description will be made of the preferred embodiments in accordance with the present invention.

FIG. 1 is a partially broken perspective view which shows around the high voltage connecting structure of an image-forming apparatus in accordance with a first embodiment of the present invention. In FIG. 1, a reference numeral 1 designates the rear plate which dually serves as the substrate that forms the electron supply source, and 2, an electron supply source area where a plurality of field emission devices, surface conduction electron-emission devices, or some other electron emission devices are arranged together with the wiring connected with them to serve the purpose. The wiring for use of driving the electron supply source, which is not shown, is led outside the image-forming apparatus and connected with the driving circuit (not shown) of the electron supply source.

A reference numeral 11 designates the face plate that forms an image-forming member; 12, the phosphor that emits light by means of electron emitted from the electron supply source area 2; 100, the lead-out wiring of Ag or the like which is led out for the supply of voltage to the Image-forming member 12; and 4, the supporting frame which is sandwiched between the rear plate 1 and the face plate 11. The wiring for use of driving the electron supply source, which is not shown, is buried in the low fusion glass (frit glass) in the bonding portion between the supporting frame 4 and the rear plate 1, and led out externally.

As the material of the rear plate 1, the face plate 11, and the supporting frame 4, it may be possible to use various ones, such as soda lime glass, the soda lime glass whose surface is filmed with $SiO_2$, the glass whose Na content is made smaller, quartz glass, ceramics, or some others which meet the requirement.

Also, a reference numeral 101 designates the lead-in terminal that leads in the voltage supplied from the high voltage supply source externally arranged; 102, the terminal supporting member which is integrally formed on the center of the column configuration of the lead-in terminal 101 which is airtightly processed in advance by use of solder material, such as Ag—Cu, Au—Ni. As the material of the terminal supporting member 102, it is preferable to adopt alumina or some other ceramics, or the material having a thermal expansion coefficient close to that of the rear plate material, such as the glass the Na content of which is made smaller, but still insulating. In this manner, it is possible to prevent cracking in the bonding portion between the terminal supporting member 102 and the rear is plate 1 due to the difference in the thermal expansion when the temperature becomes higher.

A reference numeral 103 designates the terminal lead-in hole provided for the rear plate 1, that is, the through hole to lead in the terminal supporting member 102 which is integrally and airtightly formed together with the lead-in terminal 101, and 104, the connecting member formed by metallic material, such as Ag paste, that electrically connects the lead-in terminal 101 and the lead-out wiring 100. Here, as the connecting member 104, it may be possible to use a mechanical member, such as a cantilever spring, a coil spring, or a double end supporting spring, to be described later.

Further, the structure is arranged so that frit glass 200 is applied to the space between the faces having the terminal supporting member 102 and the electron supply source 2 of the rear plate 1 installed, respectively, that is, the space between the inner faces of the container, or on the side face of the terminal lead-in hole 103, hence making the adhesive sealing possible for fixation. The adhesive sealing of the container as a whole may be executable by the application of frit glass 201 to adhesively seal the upper and lower faces of the supporting frame 4 (that is, the faces where the face plate 11 and the rear plate 1 abut upon, respectively).

Also, as the kind of the electron-emission devices that constitute the electron supply source to be used for the present invention, there is no particular limitation if only the properties of the device, such as the electron emission characteristics and size, are preferably applicable to a target image-forming apparats. Here, it may be possible to use hot electron emission devices, field emission device, semiconductor electron emission device, MIM electron emission device, surface conduction electron-emission device, or some other cold cathode devices. For the embodiments which will be described later, the surface conduction electron-emission devices are preferably used for the present invention. Here, the surface conduction electron-emission device is the same as the one disclosed in the specification of the application filed by the applicant hereof (Japanese Patent Application Laid-Open No. 7-235255).

Figure 2:
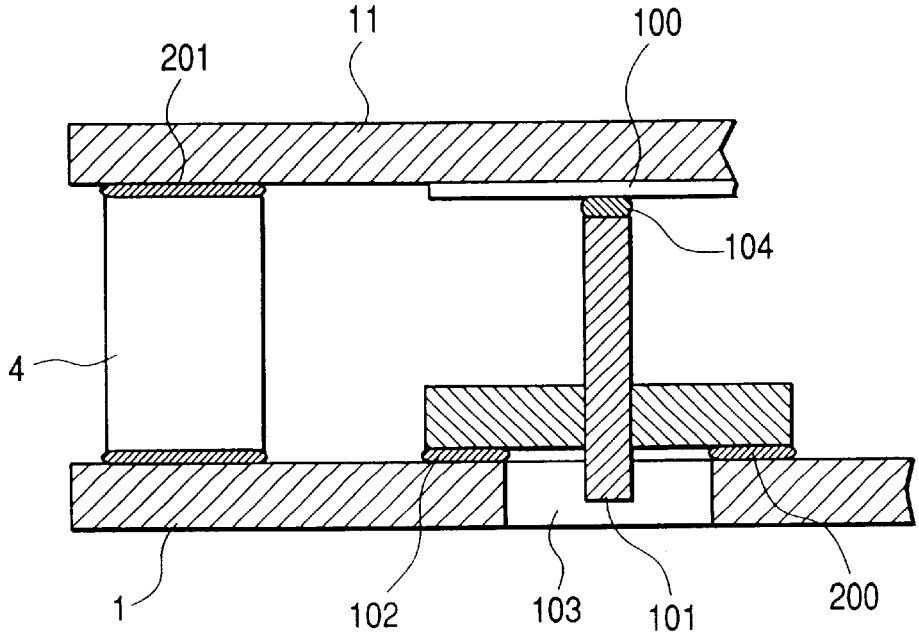
FIG. 2 is a cross-sectional view which shows one example of the anode connecting structure of the image-forming apparatus in accordance with the present invention.
Figure 3A:
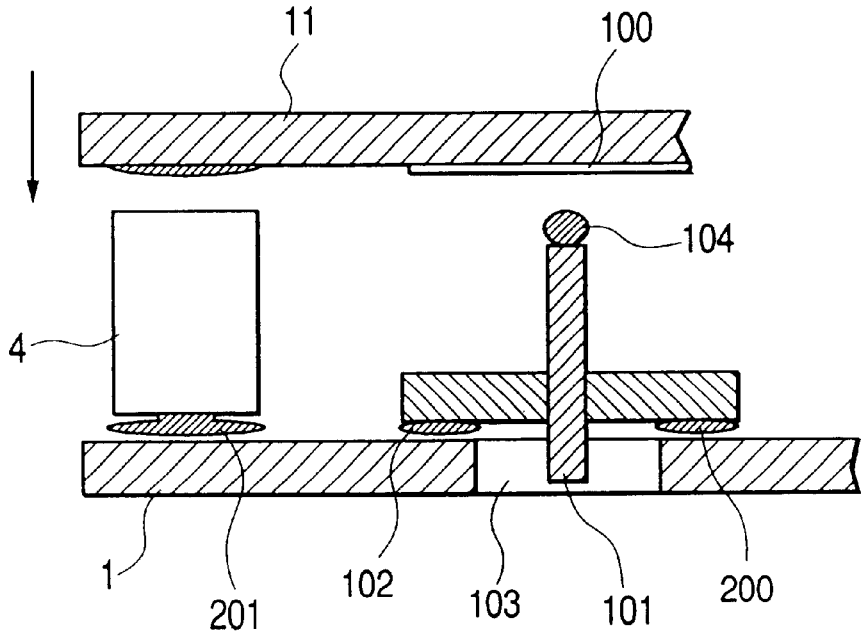
FIGS. 3A and 3B are views which illustrate the main process of manufacture of a method for manufacturing an image-forming apparatus in accordance with the present invention.
Figure 3B:
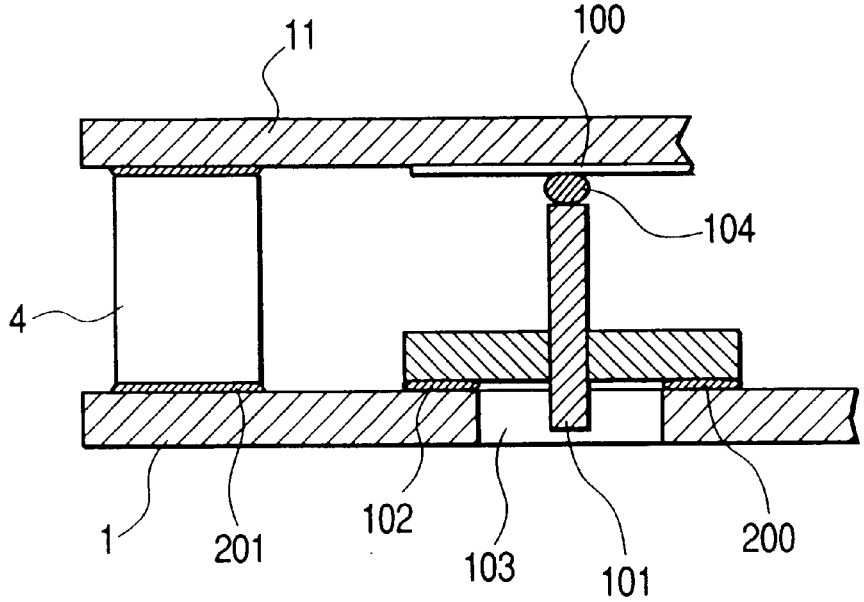

FIG. 2 and FIGS. 3A and 3B are views which illustrate the specific example of the structure in accordance with a first embodiment hereof. FIG. 2 is a cross-sectional view showing the structure of the anode terminal. FIGS. 3A and 3B are also cross-sectional views which illustrate the processes in which the anode terminal structure is manufactured.

In FIG. 2, and FIGS. 3A and 3B, a reference numeral 1 designates the rear plate formed by soda lime glass, which mounts the electron supply source on it; 2, the electron supply source area where the surface conduction electron-emission devices disclosed in the specification of Japanese Patent Application Laid-Open No. 7-235255 are arranged in matrix, which is connected with the electron supply source driving circuit (not shown) after being led outside the image-forming apparatus from the flexible wiring, which is not shown, for use of driving the electron supply source.

A reference numeral 11 designates the face plate which is formed by the soda lime glass having the phosphor mounted on it; 100, the lead-out wiring formed by the printing by use of Ag material in order to supply voltage to the image-forming member 12 (see FIG. 1); and 4, the supporting frame formed by soda lime glass which is sandwiched by the rear plate 1 and the face plate 11. The wiring, which is not shown, for use of driving the electron supply source is buried in the frit glass 201 (LS3081 manufactured by Nippon Denki Glass K. K., for example) in the bonding portion between the supporting frame 4 and the rear plate 1, and then, this wiring is led out externally.

A reference numeral 101 designates the lead-in terminal formed by 426 alloy material; 102, the terminal supporting member of $Al_2O_3$ ceramics, which is integrally formed on the center of the column of the lead-in terminal 101, soldered in advance by use of Ag—Cu, and sealed airtightly in the evacuation process; 103, the terminal lead-in hole of 10 mm diameter which leads in the terminal supporting member 102 integrally and airtightly formed with the lead-in terminal 101; and 104, the connecting member formed by Ag paste applied to the leading end of the lead-in terminal 101 in advance. Also, the lead-in terminal 101 is structured so that it does not extrude from the main surface of the reverse side of the rearplate 1.

Now, in conjunction with FIGS. 3A and 3B, the description will be made of the process in which the terminal supporting member 102 thus structured to provide the lead-in terminal 101 is connected with the lead-out wiring 100.

In FIG. 3A, the lead-in terminal. 101 is soldered by means of Ag—Cu in advance. Then, the adhesive sealing process is made by use of the frit glasses 200 and 201 (LS3081 manufactured by Nippon Denki Glass K. K.) in order to adhesively seal the connecting portion of the alumina ceramic terminal supporting member 102 with the rear plate 1 (that is, the inner face of the rear plate 1 on the circumference of the terminal lead-in hole 103), which is integrally formed on the center of the column by the airtight sealing in the evacuating process, and the upper and lower portions of the frame 4 that forms the vacuum container as well. In the adhesive sealing process, all the structural members of the vacuum container are heated at a temperature which is raised as high as 410° C. in the heat burning furnace, thus fusing the frit glasses 200 and 201. Then, the container is produced by reducing the temperature to the room temperature to enable it to maintain the airtightness thereof.

In this process, the face plate 11 is held on the external assembling apparatus so as to keep the face plate 11 in a floating condition by approximately 1 mm until the temperature reaches the one at which the material of connecting member 104 and the frit glasses 200 and 201 are fused as shown in FIG. 3A. When the fusing temperature is reached, the positions of the face plate 11 and the rear plate 1 are adjusted by the assembling apparatus so that a desired interval is kept between them.

In this case, since the connecting member 104 and the frit glasses 200 and 201 have reached the fusing temperature, these members conduct the self-adjustment so as to fill in the gap. In other words, even if the supporting frame 4 and the terminal supporting member 102 are finished by processing with the dimensional tolerances, it is made possible for the connecting member 104 and the frit glass 200 to adjust the variation of the gaps by themselves.

The vacuum container which is produced by use of the connecting means of the aforesaid lead-in terminal 101 is electrically connected with and fixed to the driving circuit substrate and the high voltage supply source installed in the housing, which are not shown here. To the lead-in terminal 101, a high voltage of 10 kv is applied to supply the driving voltage to the electron supply source formed on the electron supply source area 2. In this manner, it becomes possible to output desired images stably.

Here, the connection is stably maintained even when vibrations occur due to the transportation of the vacuum container after the manufacture thereof or due to the transportation of the housing thereof. Further, by the vibration test to apply vibrations to the housing, it is confirmed that the connection is stably made.

Also, for the anode structure of the present embodiment, there is no possibility that the terminal unit is hooked in the manufacturing process, because the arrangement is made so that no protrusions are allowed to be located on the rear plate 1 side. As a result, the production yield is enhanced. At the same time, with the flat rear plate surface, the apparatus designing or the housing design is possible without any particular consideration given to the protrusions, which may bring about the advantage that more freedom is given to designing. Further, it becomes possible to make the image-forming apparatus thinner as a whole.

In accordance with the present embodiment, it is possible to provide a new anode terminal structure having those advantages described above, and also, to provide the method of manufacture therefor.

Now, the description will be made of a second embodiment in accordance with the present invention.

Figure 4:
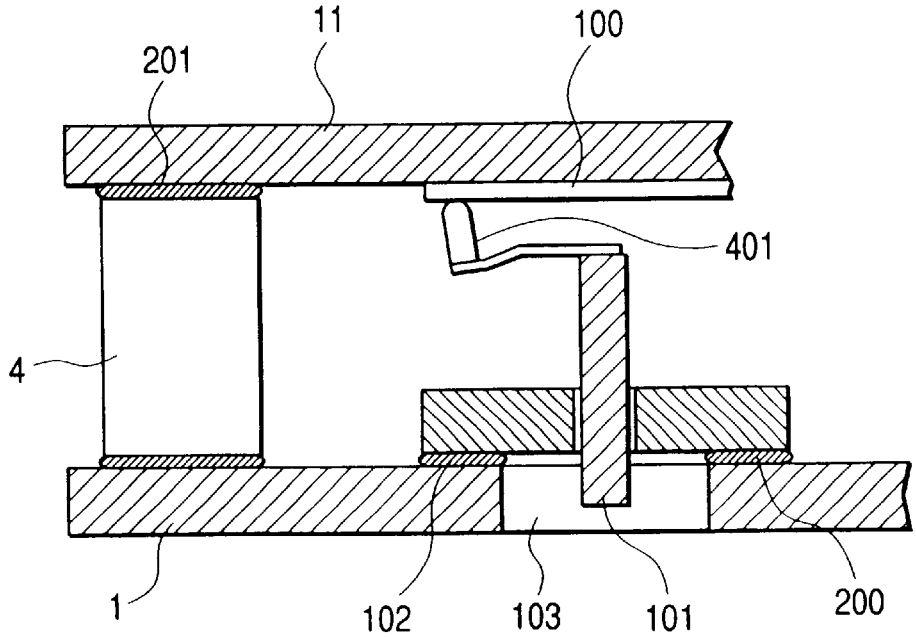
FIG. 4 is a cross-sectional view which shows the anode connecting structure of the image-forming apparatus in accordance with a second embodiment of the present invention.

The second embodiment is an example in which a structure that adopts a cantilever spring is arranged for the connecting member. FIG. 4 is a cross-sectional view which shows the anode terminal structure. The structures other than the connecting member are substantially the same as those of the first embodiment. Therefore, the detailed description thereof will be omitted.

In FIG. 4, a reference numeral 401 designates a connecting member which is formed to be a cantilever spring of 2.5 mm long and 0.9 mm wide by etching a stainless steel plate of 0.1 mm thick. Then, Al material is machined to be a semispherical member of 0.5 mm high and 0.9 mm diameter, which Is welded to the leading end of the cantilever spring by use of a laser welder. At the same time, the lead-in terminal 101 is bonded with the base end of the cantilever spring by use of the laser welder. Here, with this bonding, conductivity is secured simultaneously.

In accordance with the present embodiment thus structured, it becomes possible to make the stroke longer for the gap adjustment, because the cantilever spring which is resilient mechanical means is adopted to serve as the connecting member 401. Therefore, the dimensional tolerance can be set easier for this member with the advantage that the costs of parts can be reduced, while facilitating the manufacture thereof, among some others.

Figure 5A:
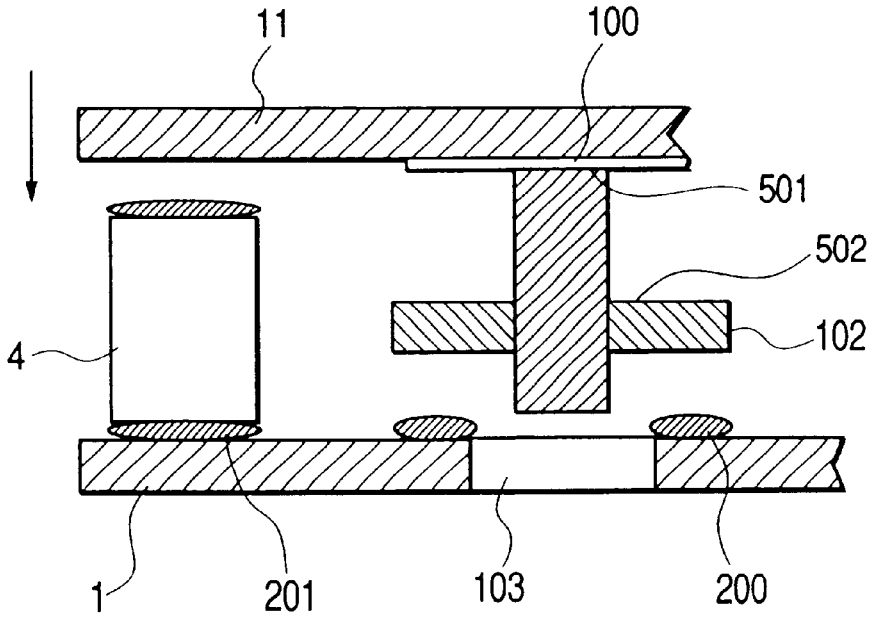
FIGS. 5A and 5B are views which illustrate the main manufacturing process of the image-forming apparatus in accordance with a third embodiment of the present invention.
Figure 5B:
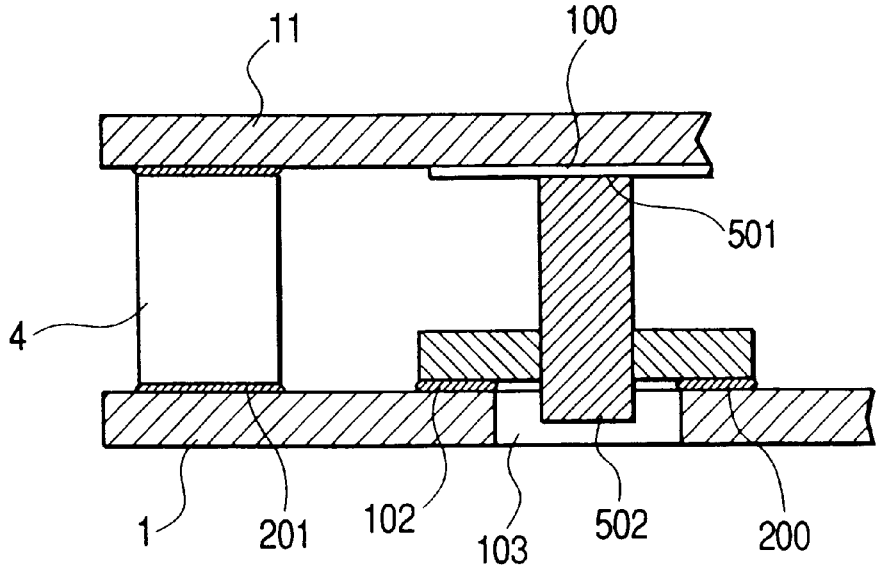

Now, with reference to FIGS. 5A and 5B, the description will be made of a third embodiment in accordance with the present invention. FIGS. 5A and 5B are cross-sectional views which illustrate the process in which the anode terminal structure is manufactured.

In FIGS. 5A and 5B, a reference numeral 501 designates a connecting member formed by Ag paste or the like for electrically connecting the lead-out wire 100 with the lead-in terminal which will be described later; 502, the lead-in terminal of 3 mm diameter, having the flat surface where it abuts upon the lead-out wiring 100. With the arrangement of the flat face configuration, the connecting member can be fixed stably on the face plate 11 side. This configuration is preferable because with the wider contact area, a stronger bonding force is obtainable stably.

In this respect, the configuration of the connecting member is not necessarily limited to the flat surface. It may be possible to appropriately select a configuration which is provided with three protrusions, for example. Any other structures than the connecting member are substantially the same as those of the first embodiment. Therefore, the detailed description thereof will be omitted.

As shown in FIG. 5A, using the connecting member 501 the lead-in terminal 502 and the airtightly sealed terminal supporting member 102 are fixed on the face plate 11 side in advance. In this state, the face plate 11, the frame 4, and the rear plate 1 are relatively positioned as shown in FIG. 5B. Then, the adhesively bonded vacuum sealed container is completed through the burning process by use of the frit glasses 200 and 201.

The advantages of this manufacturing process is that the container is completed after having confirmed whether or not the electrical conduction is possible by use of the connecting member 501, because the lead-in terminal 502 is fixed to the lead-out wiring 100 in advance. Here, even if the electrical conduction is found to be improper, the connecting member can be welded again appropriately. In this manner, the yield of production is enhanced.

Now, a fourth embodiment will be described in accordance with the present invention.

Figure 6A:
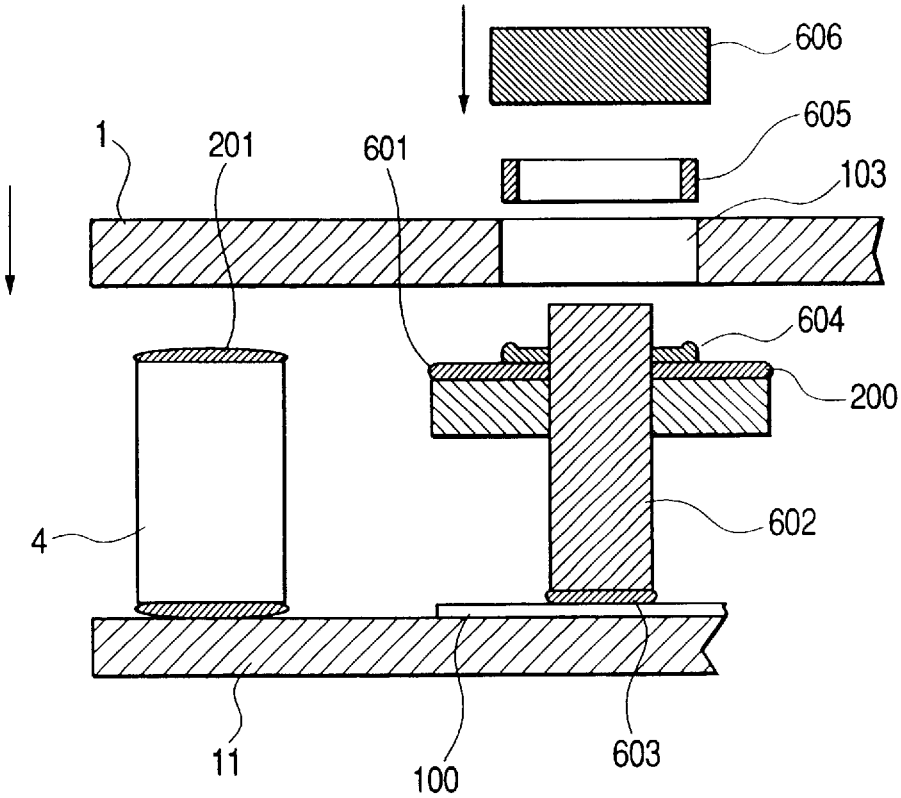
FIGS. 6A and 6B are views which illustrate the main manufacturing process of the image-forming apparatus in accordance with a fourth embodiment of the present invention.
Figure 6B:
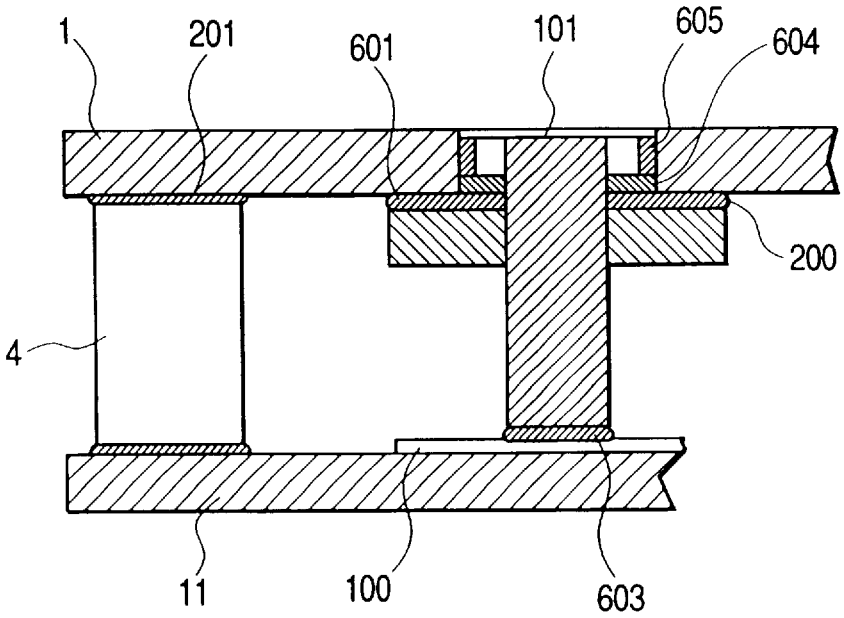

Here, with reference to FIGS. 6A and 6B, the description will be made of a method of manufacture in accordance with the fourth embodiment hereof. FIGS. 6A and 6B are cross-sectional views which illustrate the process in which the anode terminal structure is manufactured.

In FIGS. 6A and 6B, the terminal supporting member 601 is structured to support the lead-in terminal 602 formed to be a stepped column which is airtightly sealed. Here, reference numerals 200 and 604 designate frit glasses (LS3081 manufactured by Nippon Denki Glass K. K.), which are provisionally burned to be fixed to the side face of the terminal supporting ember 601 in advance. A reference numeral 605 designates an auxiliary member which is a glass ring member to provide the frit glass 604 with a weight, and 606, a weight to give a desired load weight to the frit glass 604. Although such load provided by the weight may be arbitrarily selective, a stainless steel weight of 50 g is used for the present embodiment.

Also, as shown in FIG. 6A, the method is adopted so that the container is set on the assembling apparatus for formation with the face plate 11 placed on the lower side, while the rear plate 1 is on the upper side. The lead-in terminal 602 and the lead-out wiring 100 are fixed in advance by means of the connecting member 603 that uses the Ag paste. In this state, the rear plate 1 is lowered, while being positioned on the face plate 11 side. Then, the frit glass 200 above the terminal supporting member 601, the frit glass 604 on the side face, and the frit glass 201 above the outer frame 4 are fused (at a temperature of 420° C.), and at the same time, a desired load is given to the frit glasses 200 and 604, hence assembling the container with the adhesively sealed fixation.

FIG. 6B is a view which shows the state subsequent to the assembling described above. After being cooled to a specific temperature, the weight 606, which has given the load to the frit glass 604, is removed. The ring member 605 which has been used to provide the auxiliary load is left intact as has been attached to the container, because this member is adhesively sealed by the application of the frit glass 604.

In accordance with the method of manufacture of the present embodiment, the adhesively sealed fixation is made by use of the frit glasses 200 and 604 provided for the space between the side faces of the terminal supporting member 601 and the terminal lead-in hole 103 formed for the rear plate 1, and the inner face of the container. In other words, the terminal supporting member 601 is adhesively sealed and fixed by the inner face of the rear plate 1 on the circumference of the terminal lead-in hole 103 and the inner circumferential face of the terminal lead-in hole 103. In this manner, it becomes possible to make the distance of the vacuum leak path and the bonding strength greater to manufacture a more stable container.

Now, a fifth embodiment will be described in accordance with the present invention.

Figure 7:
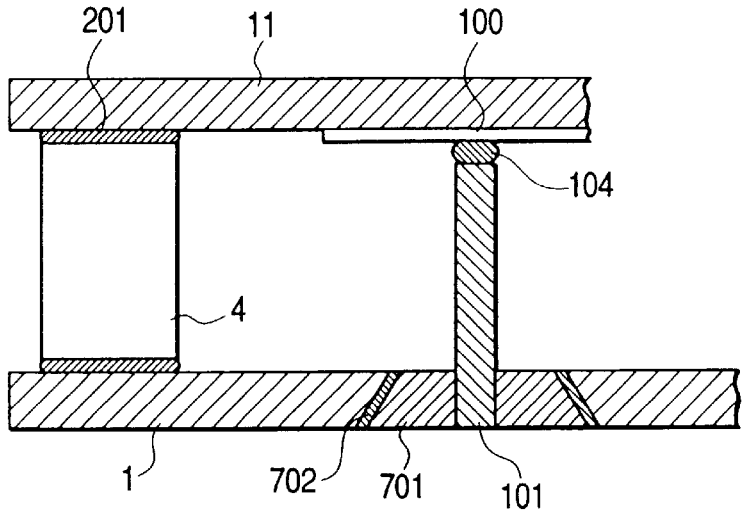
FIG. 7 is a cross-sectional view which shows the anode connecting structure of the image-forming apparatus in accordance with a fifth embodiment of the present invention.
Figure 8A:
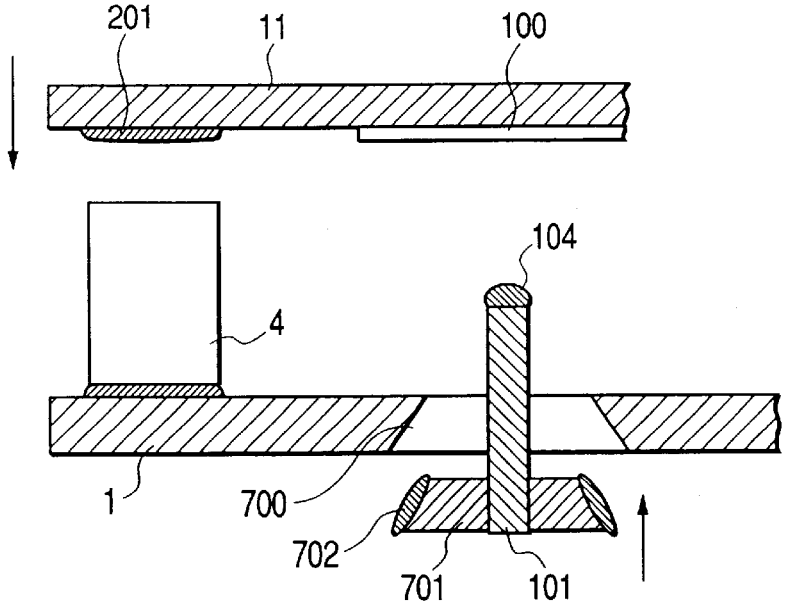
FIGS. 8A and 8B are views which illustrate the main manufacturing process of the image-forming apparatus in accordance with the fifth embodiment of the present invention.
Figure 8B:
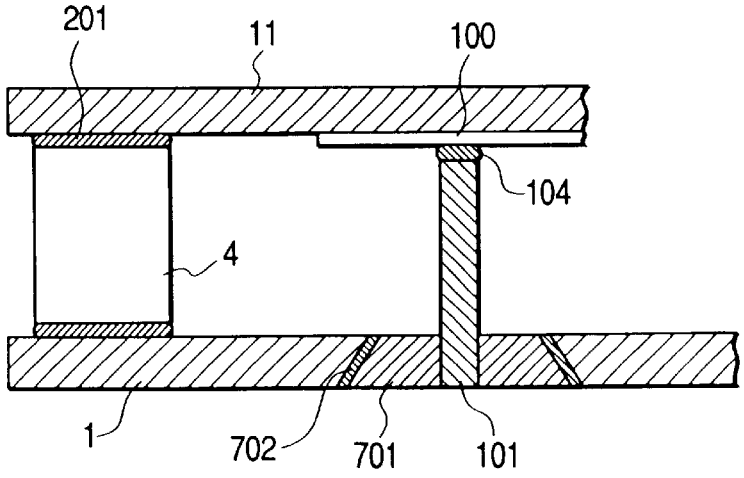

Here, in conjunction with FIG. 7 and FIGS. 8A and 8B, the description will be made of a method of manufacture in accordance with the fifth embodiment of the present invention. FIG. 7 is a partially broken perspective view which shows around the anode terminal to represent schematically the structural example of an image-forming apparatus. FIGS. 8A and 8B are views which illustrate the process in which the anode terminal structure is manufactured.

In FIG. 7, a reference numeral 1 designates the rear plate which is formed by soda lime glass having the electron supply source mounted on it, and 2, the electron supply source area where the surface conduction electron-emission devices, which are disclosed in the specification of Japanese Patent Application Laid-Open No. 7-235255, are arranged in matrix and connected with the driving circuit (not shown) of the electron supply source after being led outside the image-forming apparatus from the flexible wiring for use of driving the electron supply source, which is not shown.

A reference numeral 11 designates the face plate formed by the soda lime glass having the phosphor mounted on it; 100, the lead-out wiring formed by Ag material by means of printing for supplying voltage to the image-forming member; 4, the supporting frame formed by soda lime glass, which is sandwiched by the rear plate 1 and the face plate 11, and the electron supply source driving circuit, which is not shown, is buried in the bonding portion between the supporting frame 4 and the rear plate 1 by use of the frit glass 201 (LS3081 manufactured by Nippon Denki Glass K. K.), and then, led out externally.

A reference numeral 101 designates the lead-in terminal which is formed by 426 alloy material; 104, the connecting member formed by Ag paste, which is welded to the leading end of the lead-in terminal 101 in advance; and 701, the alumina ceramic terminal supporting member integrally formed together with the lead-in terminal 101 which is soldered by Ag—Cu in advance and sealed in the evacuating process. The side face of the terminal supporting member 701 is configured to be tapered in the same thickness as the rear plate 1. Also, as shown in FIGS. 8A and 8B, the terminal lead-in hole 700 is tapered to be wider on the outer side of the rear plate 1 corresponding to the configuration of the terminal supporting member 701. A reference numeral 702 designates the frit glass 201 (LS3081 manufactured by Nippon Denki Glass K. K.), which is positioned and fixed in advance to the tapered face of the terminal supporting member 701, that is, fixed to the inner circumferential face of the terminal lead-in hole 700 by means of the adhesive sealing.

Now, in conjunction with FIGS. 8A and 8B, the method of manufacture will be described specifically. All the structural members of the vacuum container are heated at a temperature raised to 410° C. in a burning furnace to fuse the frit glasses 201 and 702. Then, with the members returning to the normal temperature, the container is produced to be able to maintain airtightness.

In manufacturing, the face plate 11 is held in the external assembling apparatus so that the face plate 11 and the terminal supporting member 701 are kept in a state as shown in FIGS. 8A and 8B to make them apart by approximately 1 mm from each other until the connecting member 104 and the frit glasses 201 and 702 are heated to a temperature at which to fuse them. When reaching the fusing temperature, the assembling apparatus is adjusted so as to make the gap between the face plate 11 and rear plate 1 a desired one.

In this case, having reached the fusing temperature, the connecting member 104 and the frit glasses 200 and 201 make the self-adjustment so as to fill in the gap. In other words, even if the supporting frame 4 and the terminal supporting member 102 are finished by processing with the dimensional tolerances, it is made possible for the connecting member 104 and the frit glass 200 to adjust the variation of the gaps by themselves.

Also, particularly when a load is applied to the frit glass, the structure is arranged so that force is exerted on the frit glass 702 by pressing the terminal supporting member 701 to the terminal lead-in hole 700, because both the terminal supporting member 701 and the terminal lead-in hole 700 are configured to be tapered. The vacuum container thus completed is not affected by the force that may cause the frit glass 702 to be peeled off even when the terminal supporting member 701 is pressed by the atmospheric pressure. As a result, it becomes possible to produce a vacuum container which is more stable still, among some other advantages anticipated by the present embodiment.

In this respect, it has been shown to describe the case where the surface conduction electron-emission devices are used for the aforesaid embodiments as the electron-emission devices that constitute the electron supply source. However, the present invention is not necessarily limited thereto. In other words, the field emitting electron-emission devices, the semiconductor electron-emission devices, or various other kinds of electron-emission devices may be equally adoptable as the electron supply source.

Also, in accordance with the embodiments hereof, the rear plate of the image-forming apparatus functions dually as the substrate of the electron supply source. However, it may be possible to separate the rear plate and the substrate, and fix the substrate to the rear plate after the electron supply source is formed.

Also, various modifications of the disclosed embodiments, as well as other embodiments of the invention, will become apparent with reference to the description of the invention. It is therefore contemplated that the appended claims will cover any modifications as fall within the true scope of the invention.

As described above, in accordance with the present invention, it is possible to arrange the structure in which no protrusions are formed on the rear plate side. As a result, no hooking takes place in the terminal portion on the way of manufacture, hence contributing significantly to the enhancement of the production yield. Also, since the rear plate surface is flat, there is no need for giving any consideration to the protrusions in designing the apparatus or designing the housing. Therefore, the freedom of design is made wider so that the apparatus and the housing thereof may be designed more effectively at lower designing costs. Further, in accordance with the method of manufacture of the present invention, it becomes possible to effectuate the electrical conduction between the terminal and the lead-out wiring of the face plate before the container is manufactured. Therefore, no connection defects may take place after the container is manufactured, hence making it possible to enhance the production yield significantly.

What is claimed is:

1. An image-forming apparatus comprising:

a vacuum container having a first plate and a second plate arranged in opposition to said first plate;

an electron source disposed on said first plate and provided within said vacuum container;

an image-forming member disposed on said second plate within said vacuum container and irradiated with an electron emitted from said electron source; and an airtight lead-in terminal having a first end in electrical contact with said image-forming member and a second end leading outside of said vacuum container through a hole in said first plate, wherein the second end leading outside of said vacuum container is held and fixed so as not to protrude from an outer surface of said first plate.

2. An image-forming apparatus comprising:

a housing; and a vacuum container comprising:

(a) a first plate having a hole formed at a part of said first plate, and an electron source disposed on a first surface of said first plate;

(b) a second plate provided with an image forming member having a first electroconductive member on a surface of said second plate, so that the surface on which said image forming member is disposed is arranged in opposition to the first surface of said first plate on which said electron source is disposed; and (c) a sealing member for holding a second electroconductive member contacting said first electroconductive member through the hole, wherein said sealing member is seal bonded to said first plate by a bonding material so as to cover the hole, and said sealing member and said second electroconductive member do not protrude from a surface of said first plate opposite to the first surface on which said electron source is disposed.

3. An image-forming apparatus comprising:

a housing; and a vacuum container comprising:

(a) a first plate having a hole formed at a part of said first plate, and an electron source disposed on a first surface of said first plate;

(b) a second plate provided with an image forming member having a first eletroconductive member on a surface of said second plate, so that the surface on which said image forming member is disposed is arranged in opposition to the first surface of said first plate on which said electron source is disposed; and (c) a sealing member for holding a second electroconductive member contacting said first electroconductive member through the hole, wherein said sealing member is seal bonded to said first plate by a bonding material so as to cover the hole.

4. A method of manufacturing an image-forming apparatus comprising the steps of:

(1) producing a vacuum container comprising:

(a) a first plate having a hole formed at a part of said first plate, and an electron source disposed on a first surface of said first plate;

(b) a second plate provided with an image forming member having a first electroconductive member on a surface of said second plate, so that the surface on which said image forming member is disposed is arranged in opposition to the first surface of said first plate on which said electron source is disposed; and (c) a sealing member for holding a second electroconductive member contacting said first electroconductive member through the hole, wherein said sealing member is seal bonded to said first plate by a bonding material so as to cover the hole, and said sealing member and said second electrocondutive member do not protrude from a surface of said first plate opposite to the first surface on which said electron source is disposed;

(2) conveying said vacuum container produced; and (3) connecting electrically to a terminal of high voltage power source said second electroconductive member of said vacuum container conveyed.

5. The method according to claim 4, wherein said second electroconductive member has a resilient structure.

* * * * *

UNITED STATES PATENT AND TRADEMARK OFFICE

CERTIFICATE OF CORRECTION

PATENT NO. : 6,528,939 B1
DATED : March 4, 2003
INVENTOR(S) : Toshimitsu Kawase

It is certified that error appears in the above-identified patent and that said Letters Patent is hereby corrected as shown below:

Column 1,
Line 9, “therefor” should read -- therefor. --.

Column 3,
Line 43, “on one plate to the” should be deleted.
Line 44, “image-forming member formed” should be deleted.

Column 4,
Line 19, “Also;” should read -- Also, --.

Column 5,
Line 6, “Image-forming” should read -- image-forming --.
Line 31, “is” should be deleted.
Line 62, “apparats.” should read -- apparatus. --.

Column 6,
Line 46, “rearplate” should read -- rear plate --.
Line 51, “terminal.” should read -- terminal --.

Column 7,
Line 63, “Is” should read -- is --.

Column 8,
Line 61, “ember” should read -- member --.

Signed and Sealed this

Thirtieth Day of September, 2003

JAMES E. ROGAN
*Director of the United States Patent and Trademark Office*